United States Patent [19]

Giebeler, Jr.

[11] 4,400,650

[45] Aug. 23, 1983

[54] ACCELERATOR SIDE CAVITY COUPLING ADJUSTMENT

[75] Inventor: Robert H. Giebeler, Jr., Sunnyvale, Calif.

[73] Assignee: Varian Associates, Inc., Palo Alto, Calif.

[21] Appl. No.: 172,919

[22] Filed: Jul. 28, 1980

[51] Int. Cl.[3] ..... H01J 25/10

[52] U.S. Cl. ..... 315/5.41; 315/5.42; 315/5.46; 328/233; 333/232

[58] Field of Search ..... 315/5.41, 5.42, 5.46; 328/233; 333/231, 232, 233

[56] References Cited

U.S. PATENT DOCUMENTS

| | | | |
|---|---|---|---|
| 3,614,518 | 10/1971 | Schmidt | 315/5.46 |
| 3,940,721 | 2/1976 | Kojima et al. | 315/5.46 |
| 4,024,426 | 5/1977 | Vaguine | 315/5.41 |
| 4,286,192 | 8/1981 | Tanabe et al. | 315/5.41 |

*Primary Examiner*—Saxfield Chatmon, Jr.
*Attorney, Agent, or Firm*—Stanley Z. Cole; Richard B. Nelson; Leon F. Herbert

[57] ABSTRACT

In a standing-wave coupled-cavity linear particle accelerator the energy of the emergent particles can be adjusted by making the accelerating fields in one section of the accelerator different from those in another section into which the rf drive power is introduced. To do this the adjoining end cavities of the two sections are coupled through a "side" cavity which is not traversed by the particle beam. The coupling coefficients of the side cavity to the two accelerating cavities are made unequal to create the difference in accelerating cavity fields. Asymmetrical coupling is realized by varying the extension of center conductor posts into the side cavity by means of a vacuum sealed mechanism for moving the center posts while maintaining microwave current connection between the center posts and the side cavity.

6 Claims, 5 Drawing Figures

FIG.1
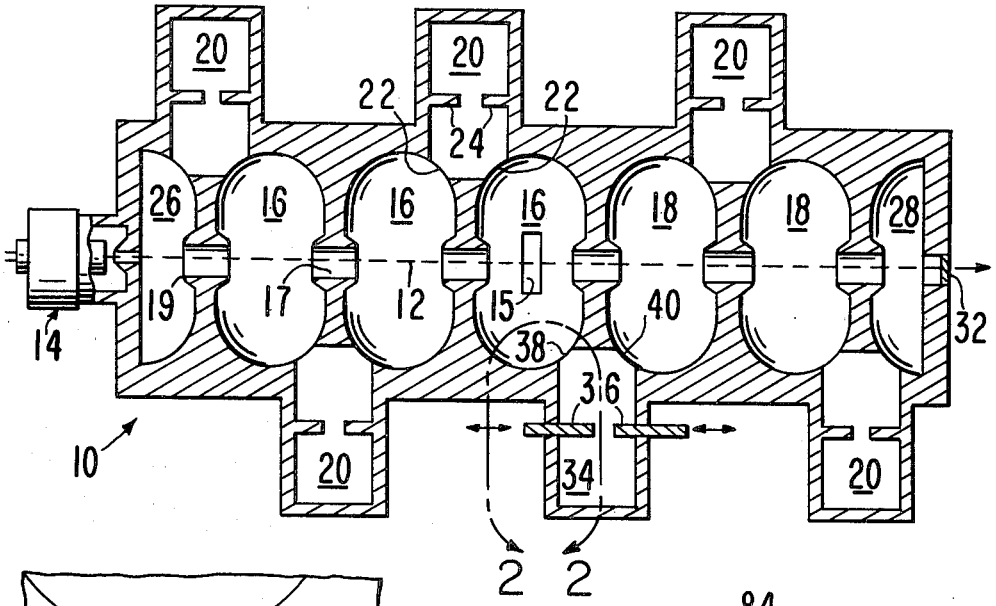
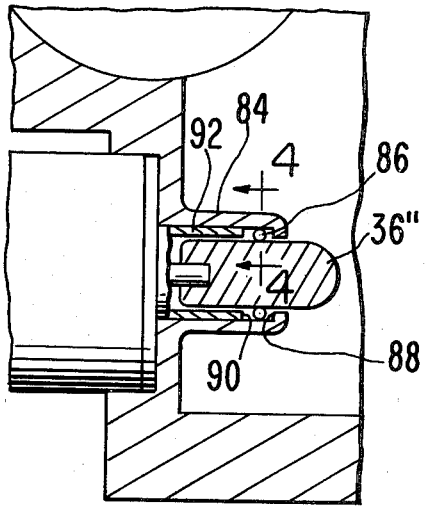
FIG.3
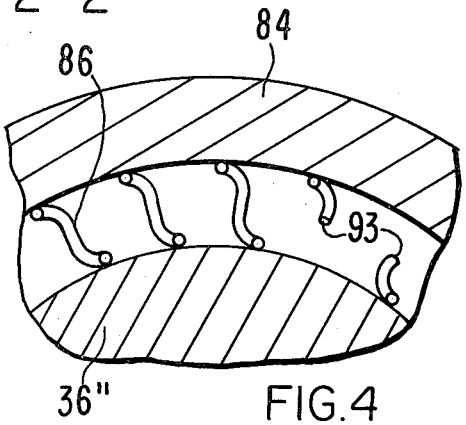
FIG.4
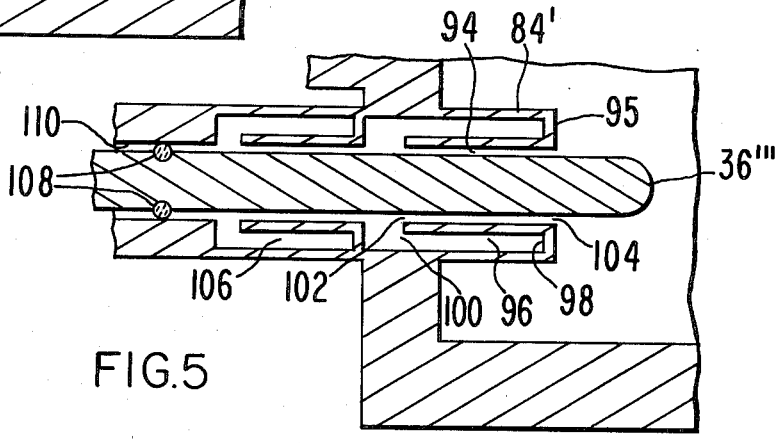
FIG.5

ACCELERATOR SIDE CAVITY COUPLING ADJUSTMENT

FIELD OF THE INVENTION

The invention pertains to standing-wave coupled-cavity linear particle accelerators, particularly those in which the accelerating cavities through which the particle beam passes are coupled to their neighbors through "side cavities" removed from the beam. The side-cavity coupled structure is the most efficient known in terms of acceleration per unit length.

PRIOR ART

The basic concept of side-cavity coupling is described in an article "Standing Wave High Energy Linear Accelerator Structure" by E. A. Knapp, B. C. Knapp and J. M. Potter in 39 Review of Scientific Instruments, 979 (1968). The commonly used form of this invention is described in U.S. Pat. No. 3,546,524 issued Dec. 8, 1970 to P. G. Stark. The side-cavity structure has important advantages in that the frequency separation of resonant modes near the operating mode is maximized, and the acceleration per unit length is also improved.

The prior-art coupled-cavity standing-wave linear accelerators have the disadvantage that it is difficult and inefficient to regulate the energy of the accelerated particles. For many applications, such as medical radiation therapy, it is important to vary the particle energy and hence the penetration into the patient. If one uses the simple approach of varying the radio-frequency power input, the efficiency of the accelerator suffers. Also, more important for medical accelerators, the energy spread of the particles becomes greater. In the first few cavities the particles, even electrons, are not yet up to the velocity of light. Hence a change in the amplitude of the accelerating fields also changes the velocity and phase of the electrons with respect to the fields. If the output energy spread is optimized for the maximum value of rf drive, it must become degraded for a lower value.

Various schemes have been proposed to alleviate this trouble, mostly based on keeping the fields constant in the cavities near the beam input and varying them in downstream cavities where electrons are traveling at essentially the speed of light and their timing is not affected by the magnitude of the fields.

U.S. Pat. No. 2,920,228 issued Jan. 5, 1960 to E. L. Ginzton and U.S. Pat. No. 2,925,522 issued Feb. 16, 1960 to M. G. Kelliher describes dividing a traveling-wave accelerating circuit into two sections, dividing the drive power, feeding a constant fraction into the upstream section and a variable fraction into the downstream section. These methods require microwave phase shifters, attenuators, circulation, etc., which are complicated, expensive and difficult to adjust.

U.S. Pat. No. 4,118,653 issued to Victor Aleksey Vaguine describes an improved method in which the upstream circuit only is a traveling-wave circuit and the full power flows through it, thence through an attenuator and phase shifter into the standing-wave output circuit. The greater energy efficiency and shorter length of a standing-wave circuit are realized. However, attenuator and phase shifter are still required.

U.S. patent application, Ser. No. 84,284, filed Oct. 12, 1979 by Eije Tanabe and Victor Vaguine U.S. Pat. No. 4,286,192, issued Aug. 25, 1981 and assigned to the assignee of the present application, describes an improved energy control for a completely standing-wave accelerator in which all cavities are driven at the same maximum level but the phase of one or more downstream cavities is reversible so that it can be used to decelerate the particles instead of accelerating them. With this system certain predetermined values of particle energy can be produced.

SUMMARY OF THE INVENTION

A purpose of the invention is to provide a compact particle accelerator with easily variable particle output energy.

A further purpose is to provide an accelerator of good efficiency.

A further purpose is to provide an accelerator with a narrow spread of particle energy.

These purposes are fulfilled by a standing-wave coupled-cavity accelerator in which adjacent accelerating cavities are mutually coupled by side cavities which are remote from the particle beam. When both the accelerating cavities and the coupling cavities have mirror image symmetry about their respective center planes, the fields in all the accelerating cavities are approximately equal. To regulate the particle energy, one (or more) coupling cavity is mechanically deformed to make its coupling coefficients different to its two adjacent accelerating cavities. According to the invention, the asymmetric coupling is achieved in a coaxial coupling cavity by mechanically extending and retracting the center conductors so that the gap between them is moved away from the center plane of the cavity. The center post is driven by a fluid-energized piston and transmitted through a flexible bellows to the post inside the vacuum. rf contact between the post and the cavity wall is by conductive sliding spring fingers, by an rf resonant choke, or by a novel rolling helical spring connector which eliminates sliding friction and wear.

BRIEF DESCRIPTION OF THE DRAWINGS

FIG. 1 is a schematic axial section of an accelerator in which the invention may be incorporated.

FIG. 3 is an axial section of a portion of another embodiment.

FIG. 4 is an enlarged section of a portion of the mechanism of FIG. 3.

FIG. 5 is a section of still another embodiment.

DESCRIPTION OF THE PREFERRED EMBODIMENTS

Figure 2:
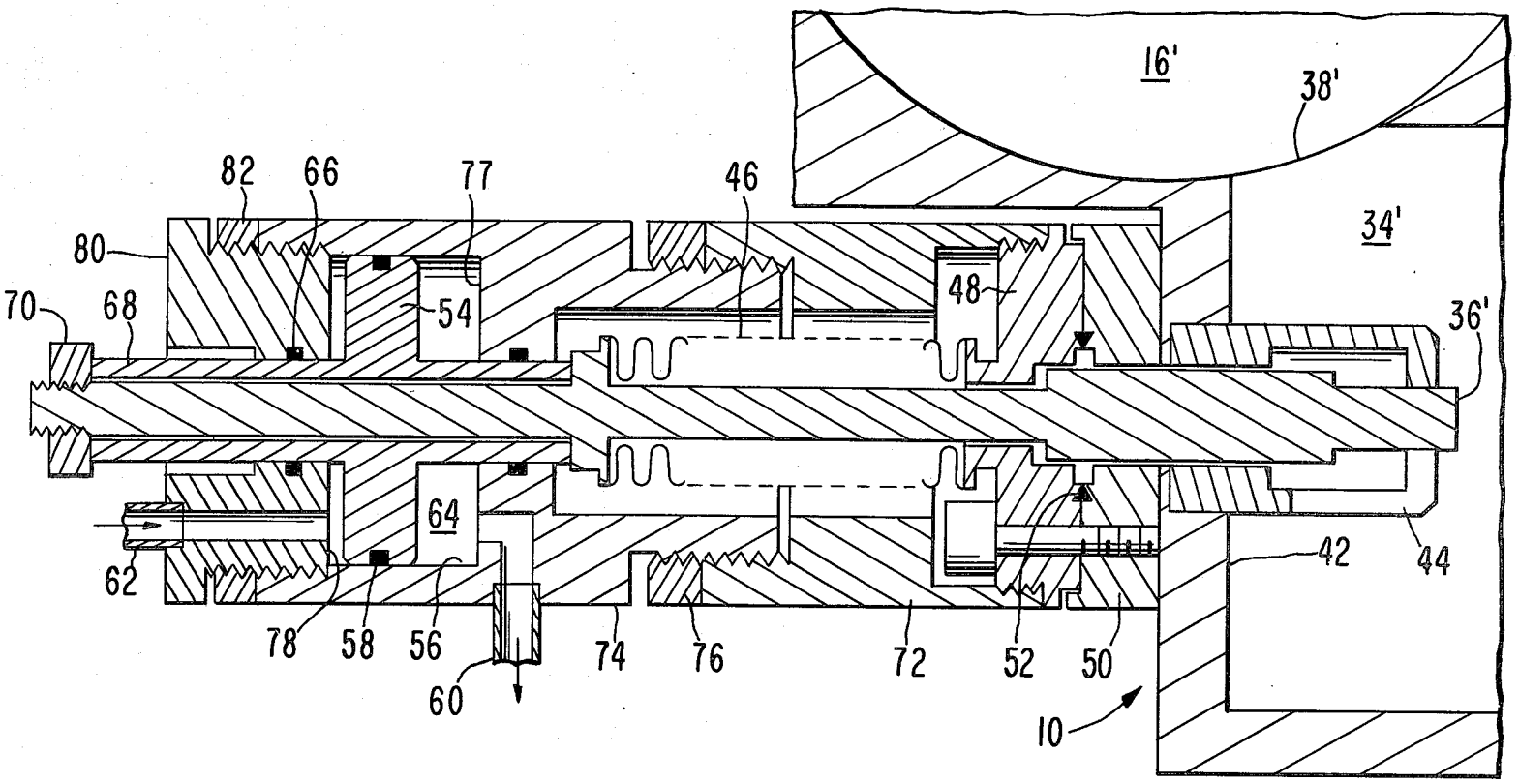
FIG. 2 is a schematic axial section of an embodiment of the invention.

FIG. 1 is a schematic axial section of a charged particle accelerator embodying the invention. It comprises an evacuated chain 10 of resonant cavities. A linear beam of electrons 12 is projected from an electron gun source 14. Beam 12 may be continuous but usually is a train of short pulses produced by applying negative voltage pulses to gun 14.

The cavities of chain 10 are driven by microwave energy at a frequency near their resonant frequency typically 3 GHz. The energy enters one cavity 16, perferably the center cavity of the chain, thru an iris 15.

The cavities of chain 10 are of two types. Accelerating cavities 16, 18 are doughnut-shaped and have central apertures 17 which are aligned to permit passage of beam 12. Cavities 16 and 18 have projecting noses 19 which lengthen apertures 17 so that the rf electric field of a cavity interacts with an electron over only a short part of the rf cycle. For electron accelerators, cavities 16, 18 are all alike because the electron beam 12 is already traveling at near the speed of light when it enters accelerator chain 10.

Each adjacent pair of accelerating cavities 16, 18 are electromagnetically coupled together thru a "side" or "coupling" cavity 20 which is coupled to each of the pair by an iris 22. Coupling cavities 20 are resonant at the same frequency as accelerating cavities 16, 18 and do not interact with beam 12. In this embodiment, they are of coaxial shape with a pair of projecting center conductors 24.

The frequency of excitation is such that chain 10 is excited in a standing-wave resonance with $\pi/2$ radians phase shift between each accelerating cavity 16, 18 and the following coupling cavity 20. Thus, there is $\pi$ radians phase shift between adjacent accelerating cavities 16, 18. The $\pi/2$ mode has several advantages. It has the greatest separation of resonant frequency from adjacent modes which might be accidentally excited. Also, when chain 10 is properly terminated, there are very small electromagnetic fields in coupling cavities 20 so the power losses in these non-interacting cavities are small. The terminal accelerating cavities 26 and 28 are made as one-half of an interior cavity 16, 18 so that the electromagnetic wave reflected from them has exactly the same phase as the wave transmitted by a uniform interior cavity 16.

The spacing between accelerating cavities 16, 18 is about one-half of a free-space wavelength, so that electrons accelerated in one cavity 16 will be further accelerated in the next cavity 16 which they transit one-half cycle later. After being accelerated, beam 12 strikes an x-ray target 32. Alternatively, 32 may be a vacuum window of metal thin enough to transmit the electrons for particle irradiation of a subject.

If all the accelerating cavities 16, 18 and all the coupling cavities 20 are similar and mirror-immage symmetrical about their center planes, the field in all accelerating cavities will be substantially the same.

To adjust the final output energy of beam 12, one of the coupling cavities, 34, is built so that it can be made asymmetrical by a mechanical adjustment. The geometrical asymmetry produces an asymmetry of the electromagnetic field so that the magnetic field component is greater at one iris 38 than at the other iris 40. The coupling coefficient between the asymmetrical cavity 34 and the preceding accelerating cavity 16 is thus different from the coefficient between cavity 34 and the following accelerating cavity 18. Asymmetric cavity 34 thus acts as a variable voltage transformer between the preceding chain of interaction cavities 16 and the following chain 18. By varying the degree of asymmetry the rf voltage in the following chain 18 can be varied while leaving the rf voltage constant in the cavities 16 near the beam input. Thus, the energy of the output beam electrons can be adjusted.

Since the formation and compaction of electron bunches from the initially continuous beam takes place in the first cavities traversed 16, the bunching can be optimized there and not degraded by the varying voltage in the output cavities 18. The spread of energies in the output beam is thus made independent of the varying mean output electron energy.

The varying energy lost by the output cavities 18 to the beam will of course change the load impedance seen by the microwave source (not shown). This will change the energy generated and, hence, produce a little change in the rf voltage in input cavities 16. This change can easily be compensated by adjusting the power supply voltage to the micrwave source, typically a magnetron oscillator.

In operation, the rf voltage is generally limited by high-vacuum arcing across a cavity. Thus, the voltage in output cavities 18 will generally be varied from a value equal to the voltage in input cavities 16 for maximum beam energy, down to a lower value for reduced beam energy.

In the accelerator of FIG. 1 the asymmetry in cavity 34 is produced by lengthening one of its center conductor posts 36 while shortening the other post 36. The resonant frequency of cavity 34 can be held constant by keeping the gap between posts 36 fairly constant, with perhaps a small relative trimming motion. The rf magnetic field will be higher on the side with the longer center post 36.

FIG. 2 shows the moving post portion of an accelerator embodying the invention. A central conductive post 36', as of copper-plated stainless steel, is axially moveable in a coupling cavity 34'. rf contact with the cavity wall 42 is via a ring of metallic spring fingers 44. To allow axial motion, post 36' is joined to the vacuum envelope 10' via a flexible metallic bellows 46 mounted on a flange 48 which is bolted to a similar flange 50 which is part of envelope 10. Flanges 48, 50 have lips 52 for a vacuum-tight compression seal with a copper gasket.

Axial motion is imparted to post 36' by a piston 54 slideably sealed in a cylinder 56 by an O-ring gasket 58. A fluid (air or liquid) under pressure is introduced through one or another inlet pipes 60, 62 to force piston 54 in or out. The fluid chamber 64 is sealed by a pair of gaskets 66 around a hollow shaft 68 which is clamped to post 36' by a threaded nut 70. Mechanical restraint for the sliding mechanism 54, 68, 36' is provided via a mounting block 72 threaded to flange 48. A bearing block 74 is threaded to mounting block 72, the thread being supplied with a lock-nut 76. Bearing block 74 has a flat transverse surface 77 forming one end of piston chamber 64 and providing a positive inward stop to the motion of piston 54. The position of this stop is adjustable by rotating the threads of bearing block 74 in mounting block 72 and securing by lock-nut 76. A positive, adjustable outward stop for motion of piston 54 is provided by the flat surface 78 of a closure block 80, which is threaded into bearing block 74 and has a lock-nut 82.

The extension of post 36' into coupling cavity 34' is shifted between two pre-set positions by applying fluid pressure to pipe 60 or pipe 62. The entire mechanism is made of non-magnetic materials to avoid perturbing the axial magnetic field used in linear accelerators to focus the beam of particles. The use of fluidic drive eliminates magnetic motors or solenoids. To adjust the accelerator energy as described in connection with FIG. 1, a pair of the mechanisms of FIG. 2 are used at opposite ends of cavity 34, one post 36 being withdrawn as the other is pushed in.

During evacuation of a linear accelerator, the vacuum envelope is baked at high temperature to drive off adsorbed and absorbed volatile contaminants. The mechanism of FIG. 2 is protected from injury by the heat by removing the critical sliding parts. Lock-nut 70 is removed and mounting block 72 is unscrewed from flange 48. Then the entire drive assembly is axially slid off, to be replaced after bake-out.

FIG. 3 is a schematic axial section of a somewhat different embodiment of the invention. A re-entrant cavity post 84 is not split into fingers and its bore is large enough to avoid contact with moveable post 36″. Electrical contact between cavity post 84 and moveable post 36″ is made by a helical spring 86 which is an interference fit between posts 84 and 36″. Spring 86 deforms slightly so that every turn is in firm contact with both conductors. Since large microwave currents are conducted, one loosely contacting turn could cause arcing and damage the surfaces. Spring 86 is not constrained to slide on post 84 or 36″ as was common in the prior art, but is free to roll over their surfaces as post 36″ is moved axially. In this way, many motions may be made without wear on the surfaces. It is known that clean metals in a high vacuum have a tendency to stick together and gall one or the other as they slide. Spring 86 is preferably made of smooth polished tungsten and posts 36″ and 84 of copper. Life tests have confirmed that post 36″ may be moved as many as 100,000 cycles with no apparent wear.

To prevent any slight cumulative "walking" of spring 86 as it rolls for many cycles, stops 88, 90 are provided on cavity post 84 and an adjustable retaining cylinder 92. The rest of the mechanism is the same as shown in FIG. 2.

FIG. 4 is an enlarged view of a part of the rolling-spring contact of FIG. 3. It is a section taken perpendicular to the axis of motion through the center of the toroidal spring 86. Spring 86 is wound as a straight helical spring ans constrained into a toroidal shape by contacting conductors 36″ and 84. At the ends 93 spring 86 is simply cut off, leaving a gap in the torus.

FIG. 5 is a schematic axial section of a portion of still another embodiment. Here conductive post 36‴ is not in electrical contact with cavity post 84′, but there is a gap 94 therebetween. Microwave currents are carried across gap 94 as electric displacement current. To make an effective short-circuit at the projecting ends 95 of post 84′, a choke section 96 is short-circuited at its outer end 98 and open-circuited as its inner end 100. Choke 96 is perferably ¼ wavelength long. Then the low impedance at outer end 98 transforms to a high impedance at inner end 100. This provides a very high impedance at the inner end 102 of gap 94, which in turn transforms to a very low impedance at its outer end 104, thus providing the effective short circuit.

To make the choke even more effective, a second quarter-wave section 106 may be provided behind the first choke 96. With non-contacting chokes, post 36‴ needs some bearing supports to keep it centered inside cavity post 84′. These may be provided outside the vacuum envelope (not shown) where they can be lubricated. Alternatively, polished sapphire spheres 108 may be used as bearings inside the vacuum, sliding on a soft copper surface 110.

It will be obvious to those skilled in the art that many varying embodiments of the invention may be made within its true scope. The above examples are illustrative and not limiting. The invention is to be limited only by the following claims and their legal equivalents.

I claim:

1. In a coupled-cavity standing-wave linear particle accelerator having a resonant coaxial side cavity mutually coupled to two adjacent accelerating cavities, means for adjusting the extension into said side cavity of a conductive center post of said cavity comprising: an axially slidable stem supporting said center post, means for making a radio-frequency connection between said center post and a wall of said side cavity, axially flexible bellows means sealed between said stem and said wall for maintaining vacuum in said side cavity, fluid actuated piston means attached to said stem for axially propelling said center post, first adjustable stop means for fixing the maximum inward motion of said post, and second adjustable stop means for fixing the maximum outward motion of said post.

2. The accelerator of claim 1 wherein said means for making a radio-frequency connection comprises an array of radially flexible conductive members attached to said wall and having contact portions held by spring force against said center post.

3. The accelerator of claim 1 wherein said means for making a radio-frequency connection comprises non-contacting resonant choke means between said center post and said wall.

4. The accelerator of claim 1 comprising two of said means for adjusting the extension into said side cavity of a conductive center post of said cavity, the center posts with their respective adjusting means being positioned at opposite ends of said side cavity, and each said piston means being separately adapted for fluid propelling in opposite directions, whereby said extension of said center posts may be separately reversed.

5. The accelerator of claim 1 wherein said adjustable stop means comprise limiting stop surfaces substantially perpendicular to the direction of motion of said stem and threaded connections between said stop surfaces and said wall, said threads being coaxial with said stem.

6. The accelerator of claim 1 further comprising means for removeably attaching said piston means and said stop means from said wall, whereby said piston means and said stop means may not be subjected to the bakeout of said accelerator.

* * * * *